US005125116A

United States Patent [19]

Gaither et al.

[11] Patent Number: 5,125,116

[45] Date of Patent: Jun. 30, 1992

[54] SOCK WITH SIMULATED STIRRUP

[75] Inventors: Hugh R. Gaither, Newton; James R. Richard, Conover, both of N.C.

[73] Assignee: Ridgeview, Inc., Newton, N.C.

[21] Appl. No.: 626,000

[22] Filed: Dec. 12, 1990

[51] Int. Cl.[5] ..... A41B 11/00

[52] U.S. Cl. ..... 2/239; 66/178 R; 66/180; 66/181

[58] Field of Search ..... 66/178 R, 180, 181; 2/239; D2/329, 330, 331, 332, 333, 334, 335, 336, 337, 338, 339, 340, 341, 342

[56] References Cited

U.S. PATENT DOCUMENTS

D. 242,829 12/1976 Connelly ..... D2/341
D. 243,485 3/1977 Hedgepeth ..... D2/330
D. 254,101 2/1980 Gilbert ..... D2/331
D. 277,333 1/1985 Abramowitz ..... D2/331
D. 283,557 4/1986 Houston ..... D2/331

*Primary Examiner*—Werner H. Schroeder
*Assistant Examiner*—Gloria Hale
*Attorney, Agent, or Firm*—Olive & Olive

[57] ABSTRACT

A one-piece integrally circular knit athletic sock is provided which simulates the appearance of a separate stirrup being worn over the sock. The straps of the conventional stirrup are simulated and made prominent by a pair of stripes of a color which contrasts with the color of the body of the sock and which extend downwardly for a length sufficient to insure for the sake of appearance that the lower ends of the stirrup strap simulating stripes are below the normal level of the top of the athletic shoe. The curved front and rear edges of the stirrup straps are simulated by straight border lines but which resemble the curved lines when seen from a distance.

7 Claims, 3 Drawing Sheets

SOCK WITH SIMULATED STIRRUP

BACKGROUND OF THE INVENTION

1. Field of the Invention

This invention relates to the field of athletic socks, and more particularly to a sock which simulates the appearance of a stirrup being worn over the sock as used in baseball uniforms.

2. Description of the Related Art

A stirrup garment has been a part of the uniform in the game of baseball for many years. The stirrup is a covering for the shin and calf portion of the leg of the player and is partly held in place by its characteristic strap passing under the arch of the foot. It has been used by all classes of baseball players where a uniform is worn and may be used by softball players as well.

Although the traditional stirrup worn over the sock is appreciated for its appearance, it has a number of disadvantages as addressed and corrected by the invention herein disclosed.

One quite obvious drawback is that purchasing both a stirrup and a sock is expensive. A second recognized problem is that donning a stirrup over a sock is difficult because of the need to overcome both the bulk and the friction, especially for children. This bulk factor makes donning the shoe over both garments difficult and can interfere with proper fit and comfort. In addition, since the stirrup is not anchored over the toe, there is a risk that the stirrup can slip out of the heel area of the shoe and be an uncontained loop which could get caught on a base, a bat, or the foot of a player.

The problems pertain especially to the use of stirrups over socks by young baseball and softball players such as those who play in the Little League, Babe Ruth League, etc. These young baseball players also may tend to lose various parts of their uniform thus indicating a need for simplification. As can be readily appreciated, the youth baseball and softball uniform business entails a very significant, if not the dominant part of the market in uniform manufacture and sales. Virtually every town has its Little League team and cities often have many teams each. A significant number of players appear to like to display the appearance of a stirrup before other players both before and after they don their full uniform.

The discussion above focused on the problems of a separate stirrup to go over a sock from the perspective of the wearer. There are also a number of disadvantages for the manufacturer as well. To produce a stirrup, it is first necessary to knit a sock-like garment. Next, the parts that would be the toe and the heel are cut away, leaving a strap which will fit under the arch of the wearer. In order to avoid fraying of the cut knit edges, the edges are overstitched in another operation. Thus, a three step process is required to make this piece, as distinct from the manufacturing process for a sock which takes only knitting of the sock body and stitching the toe closed. Additionally, the fabric which is cut away to produce the stirrup straps is wasted.

In prior attempts to provide the desired stirrup-like appearance and to alleviate the problems enunciated above, socks have been produced to incorporate a side stripe for a stirrup-like look. Others have added a band around the top, creating a "T" pattern. A significant feature of the separate stirrup which is inherent in the characteristic look of a stirrup is the curvature at the top of the cut openings which creates a gradual taper from the calf portion to the straps. Both these prior styles of combination garment fail to accurately emulate the curved appearance of traditional stirrups. Hence, the previously available simulated stirrup over socks have been aesthetically unappealing to players seeking the stirrup look both before and after donning their full uniform.

In the prior attempts to create a one-piece sock which simulates the combined appearance of the stirrup and the sock, two ideas have been expressed in U.S. design patent. In U.S. Pat. No. Des. 242,829, a one-piece garment combining some features of the simulated stirrup on a sock is displayed. In U.S. Pat. No. Des. 254,101, similar features are shown, with the added characteristic of having a side stripe simulating a stirrup strap and shown extending to the bottom of the foot portion of the sock. While it is possible to produce the socks described in the patents in previously available manufacturing systems, the cost of this manufacture was excessive. A comparison is that the machine preparation time of the old system could be as much as forty (40) hours compared to less than one (1) hour for the system associated with the present invention. Also, the rate of production of the prior system was of the order of twenty-four (24) pairs per machine per eight (8) hour shift compared to approximately eighty (80) pairs per machine per eight (8) hour shift with the present invention. Therefore, the present invention adds both a factor of economy of production for the maker and economy of purchase for the buyer.

Therefore, a primary object of the invention is to create a sock which simulates the appearance of the original two garment sock-stirrup system as worn, without the attendant problems.

An additional object of the invention is to create a sock which creates the appearance of a stirrup being worn over the sock while having all the convenience and comfort associated with a single sock.

A further object is to create a sock having the appearance of a combination stirrup and sock but which is more economical to manufacture and to purchase.

Additional objects of the invention will become apparent from the following description.

SUMMARY OF THE INVENTION

The invention relates to a knitted sock having the appearance when worn of being a combination stirrup and sock and produced on a pattern controllable circular knitting machine having multiple yarn change capabilities. The resultant single garment closely duplicates the appearance and eliminates the majority of the disadvantages of the older two garment, sock-stirrup, system. In particular, a wide upper band is knit which blends with a smooth, gradual transition to vertical stripes which simulate the conventional stirrup straps. The resultant appearance is much closer to the traditional look of the stirrup than previously achieved.

DETAILED DESCRIPTION OF THE PREFERRED EMBODIMENT

Figure 1:
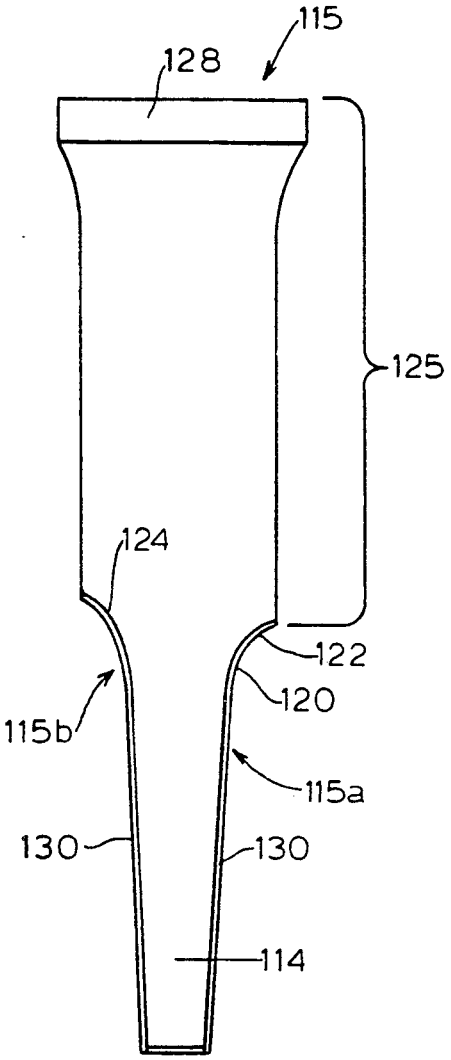
(PRIOR ART) FIG. 1
FIG. 1 is a side view of a traditional separate circular knit stirrup of the prior art, the opposite side view being a mirror image of the side shown.

As previously explained, the traditional uniform of the game of baseball has for many years used a circular knit stirrup similar to that depicted in FIG. 1 over a sock. The stirrup 115 has a leg portion 125 to cover the shin and calf extending below a top garter band 128. As can be seen in FIG. 1, the toe section 115*a* and heel section 115*b* are cut away and form apertures bordered by edges 120 which surround the vertical side straps 114 only one of which is shown. In some styles, border 130 comprises an overlocked stitched line to prevent unravelling of the cut knitted edge 120 and is stitched in a contrasting color for appearance. A portion of the front transitional inwardly curved taper 122 is typically located below the rear transition inwardly curved taper 124 as shown. The impetus to replicate the appearance of a traditional stirrup in a one-piece garment having the appearance of a stirrup and sock is for practical reasons, but carries with it the need to imitate the appearance of the two garments. To date, this has not, as previously mentioned, been successfully accomplished in a commercial product.

Figure 2:
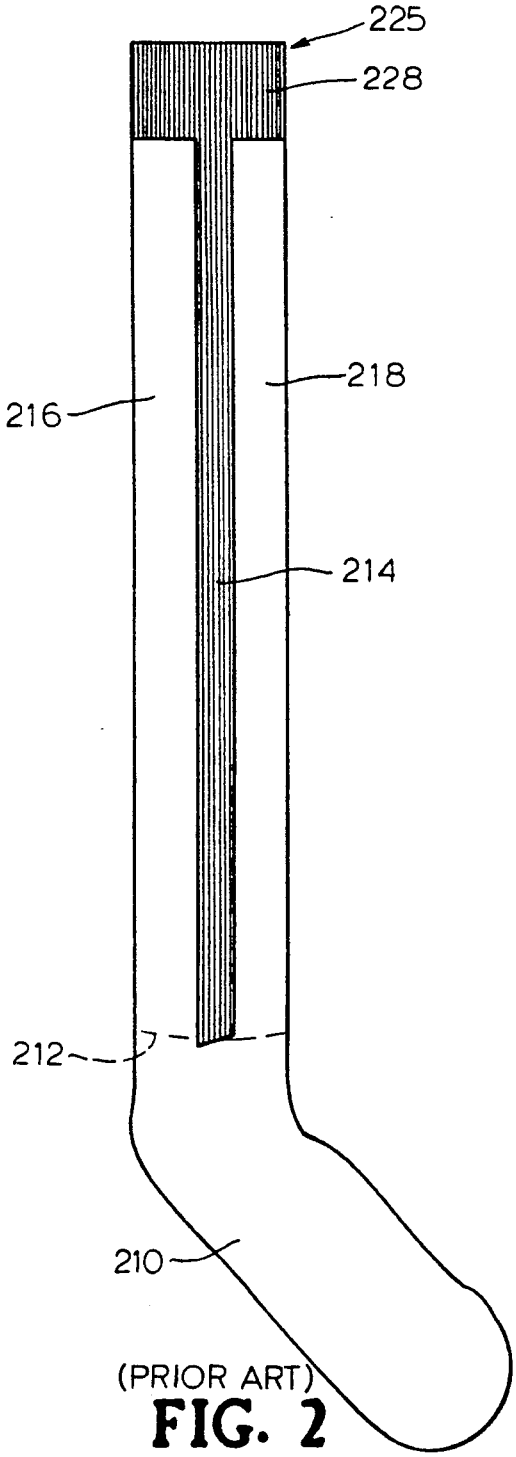
(PRIOR ART) FIG. 2
FIG. 2 is a side view of a prior art sock which attempts to at least partially emulate the appearance of a stirrup by incorporating side stripes of a contrasting color to emulate the appearance of the stirrup straps, the opposite side view being a mirror image of the side shown.

The type of prior art sock 225 shown in FIG. 2 is believed to be typical of earlier attempts to incorporate the appearance of a stirrup over a sock. FIG. 2 shows a contrast band 228 at the top which may at least in part constitute an elastic garter band and which is joined to the stirrup strap simulating vertical stripe 214 in a perpendicular transition. Front panel 218 and rear panel 216, in this example, are typically the same color as the foot portion 210 below reference line 212 whereas band 228 and stripe 214 are of a different contrasting color. Vertical stripe 214 which simulates the stirrup strap 114 extends downward to about the level of reference line 212 at which the top of the player's shoe would normally reside.

Figure 3:
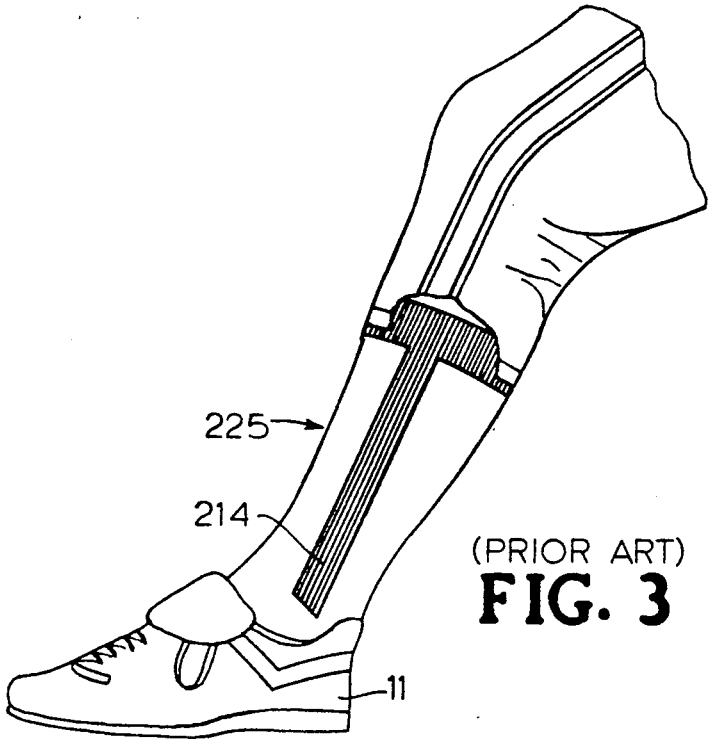
(PRIOR ART) FIG. 3
FIG. 3 is an illustration of the prior art sock of FIG. 2 as worn in a baseball uniform with the uniform cut away to show the upper portion of the sock and showing its side stripe terminating above the shoe level which is undesired.
Figure 4:
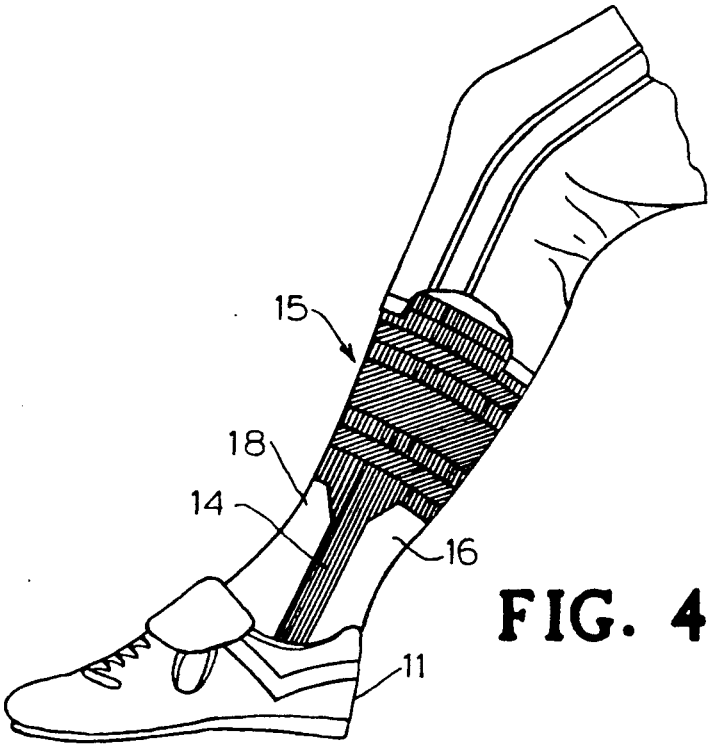
FIG. 4 is a side view of the simulated combination stirrup and sock of the present invention as seen in FIG. 5 and with the uniform cut away to show the upper portion of the FIG. 5 sock and also showing its side stripe terminating in the shoe of the wearer which is a desired appearance.
Figure 5:
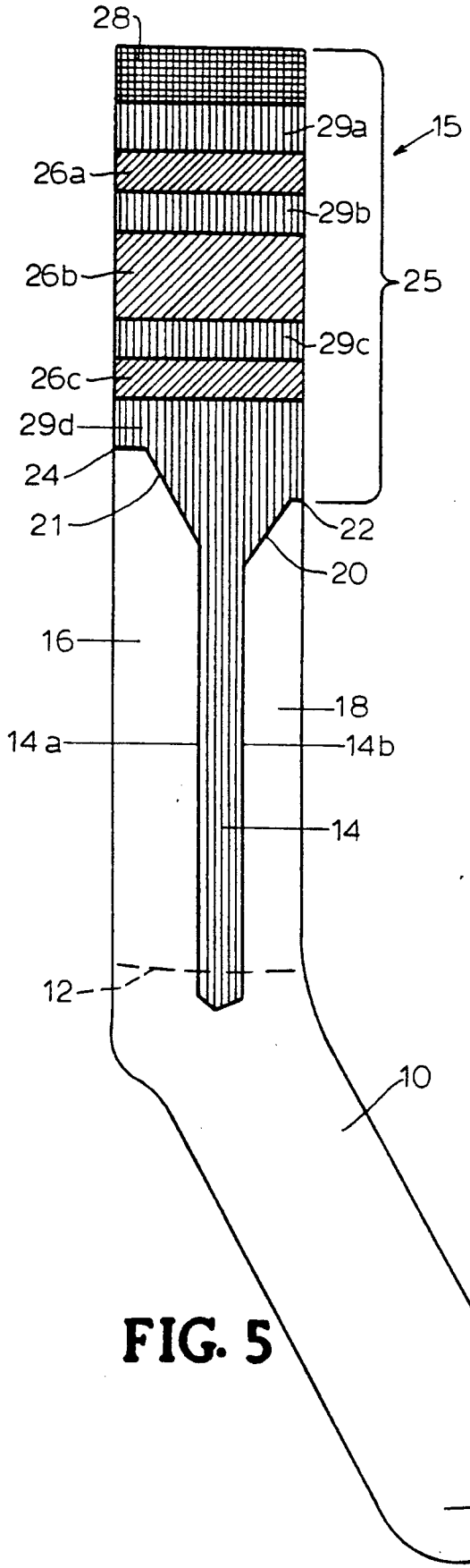
FIG. 5 is a side view of the simulated combination stirrup and sock according to the first embodiment of the inventor with bands of contrasting color in the upper part and a solid side stripe simulating the stirrup straps, the opposite side view being a mirror image of the side shown.

FIG. 3 illustrates the prior art sock 225 of FIG. 2 as worn whereas FIG. 4 depicts the FIG. 5 sock 15 of the invention as worn. From this comparision, it will be seen that the strap simulating stripe 214 of the prior art sock 225 leaves a gap above the line of the top of the shoe 11. In contrast, the simulated stirrup on the sock 15 of the present invention as in FIG. 4 has a simulated stirrup strap stripe 14 which continues below the level of the shoe top, leaving no gap. The sock 15 of FIG. 5 when worn as in FIG. 4 thus more closely simulates the appearance of the traditional separate stirrup of FIG. 1. Even though it has been known, as previously mentioned, to avoid the gap, it has not been known to avoid such gap with a sock such as provided by the construction of the invention.

It has been discovered that manufacture of the simulated combination stirrup and sock of the invention is best accomplished according to the present invention on a magnetic tape controlled 5 Cus model circular knitting machine manufactured by Sangiacomo of Brescia, Italy having 112 needles. Other derivations for greater or lesser definition of pattern can be made with the same model having from 72 to 200 needles, although 176 needles is the maximum allowed if a terry cloth is to be knitted. This type of weft knitting machine and method of knitting has been discovered to be particularly advantageous for simulating the respective front and rear transistional tapers 122, 124 of the stirrup as seen in FIG. 1. It has been discovered that the short, substantially straight angled edge or border lines such as lines 20, 22 in FIG. 5, very closely simulate when the invention sock 15 is worn the curved lines 122, 124 of FIG. 1 when seen from a relatively short distance of, for example, fifteen feet or less.

Figure 6:
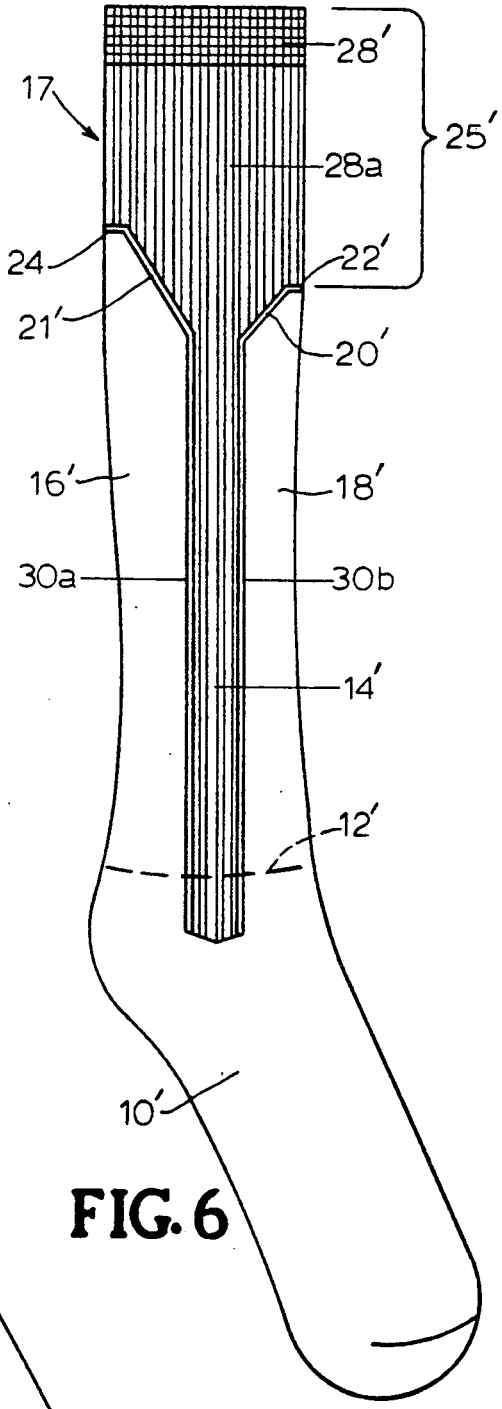
FIG. 6 is a side view of the simulated combination stirrup and sock with a solid upper part and a contrasting border along the side stripe according to a second embodiment of the present invention.

To achieve an athletic sock garment of proper fit and comfort requires a degree of stretch in the leg portion and a degree of cushioning in the foot portion. While a covered elastomeric yarn will achieve stretch, it interferes with good color control. Therefore, the leg portions of both of the illustrated embodiments of the sock of the invention as seen in FIGS. 5 and 6 are preferably made with predyed synthetic thermoplastic body and skeleton yarns that have been texturized. This obtains good stretch and shape retention while not sacrificing color control.

With respect to both the first embodiment of FIG. 5 and second embodiment of FIG. 6, the preferred body and skeleton yarns for knitting the entire upper section of the simulated combination stirrup and sock down to and somewhat below reference line 12 are texturized nylon yarns. In particular, a 140 denier texturized nylon yarn is used as the skeleton yarn to contribute a continuous base as the body yarn is being changed to switch color within a course in the garment. The body yarn which appears on the outer surface and works satisfactorily in both embodiments is a 400 denier texturized nylon. The 400 denier nylon body yarn in the stripe 14 continues to a level below the terry line 12 where the body yarn is also terried. The foot 10 up to the terry line 12 and on both sides of the stripe 14 is made of a 12's count cotton yarn.

While the construction will vary according to size, a typical construction which achieves the desired properties is made at a density of 24 courses per inch, has a relaxed body width of 7¼ inches and a stressed width of 8½ inches. Measurement of the differential between the relaxed width and the stressed width is done by a standard spring tension Stretchette sock stretch measuring caliper.

The first embodiment of the invention as seen in FIG. 5 includes an elastic garter band 28 knitted on the machine previously described. A leg portion 25 includes both the top band 28, a connecting band 29*a* and a series of bands 26*a*, 26*b*, 26*c* of one color interspersed with bands 28, 29*a*, 29*b*, 29*c* and area 29*d* and stripe 14 of another color. As an example, when bands 28, 29*a*, 29*b*, 29*c*, area 29*d* and stripe 14 are of a blue color, bands 26*a*, 26*b* and 26*c* and stripe 14 are of a yellow color and the remainder of the sock is white, both an attractive appearance and a stirrup-like appearance are achieved. Leg portion 25 continues down to a point where the substantially straight line of rear transition taper 21 begins with the substantially straight horizontal border line 24 which joins angular border line 21 to connect with the rear edge line 14*a* of the stirrup strap simulating vertical stripe 14. Several courses further down on the leg portion 25 the substantially straight line of front transition taper 20, proceeding from the substantially border line 22, joins the front edge line 14*b* of the vertical stripe 14. The stirrup strap simulating vertical stripe 14 continues down each side of the sock 15, bordered by the body color which by way of example, may be white. Thus the pattern accomplishes an appearance closely resembling that of the traditional stirrup in a one-piece knit construction.

A particular feature of the present invention that distinguishes over the garments of the prior art is the ability to achieve what appears when the invention sock 15 is worn as a gradual transition taper between upper borders 22, 24 and vertical stripe 14. This is done by a series of finite steps in the change of yarn within a knitting course, changing one wale closer on each side of the vertical stripe 14 with each succeeding course of knitting. Even though the previously described relatively short border lines 22, 20 and 24, 21 are formed in steps, they appear when sock 15 or 17 is worn as substantially straight lines from a distance of a few feet much like the inwardly curved taper lines 122, 124 of FIG. 1.

The construction of the garment is completed with the foot section 10. From a level at approximately reference line 12 downward, the interior of the sock 15 is terried to create a cushioned and absorbent fabric. The terry loop is accomplished as is commonly known in the industry by the interception of the knitting yarn with a "sinker" to extend the yarn length and create the loop. A cotton or other compressible, absorbent yarn is desirable for this portion of sock 15. From line 12 which represents the level of the top of the shoe 11 (FIG. 4) and the top of the terrying, the vertical stripe 14 continues downward for a distance to end within the covering of the shoe 11 as worn.

In a second embodiment of the simulated combination stirrup and sock of the invention, depicted in FIG. 6, the upper portion of the sock 17 includes the elastic band 28' and area 28*a* as well as the simulated stirrup strap stripe 14' all of a common solid color. Vertical stripe 14' is however knitted with a contrasting color along front and rear edge lines 30, 30*a* to simulate the contrasting overlock stitching done on some of the traditional stirrups. Leg portion 25' is knit down to line 24' in the rear and to line 22' in the front. In the rear, transition taper 21' gradually angles toward and joins the rear edge line 30*a* of stripe 14'; in the front the transition taper 20' begins at a lower level and extends between line 22' and front line 30*b* of stripe 14' by following a complementary angle. Front panel 18' and rear panel 16' are typically kept in the color of the foot 10'. Stripe 14' extends below reference line 12' as previously explained.

While not shown, it is to be recognized that the stirrup-like appearance could be simulated by using yarns of contrasting color only on the borders of the stirrup portion of the sock of the invention with all other portions made of a common color.

Thus, as disclosed in the description above, the simulated combination stirrup and sock of the present invention has achieved its desired objectives and introduced useful improvements over the prior art. As will be understood by those skilled in the art, the principles outlined in this disclosure offer broad opportunities and, as such, are not to be interpreted as being limited by the specific embodiments herein.

What is claimed is:

1. A knit athletic sock constructed so as to simulate when worn the appearance of having a circular knit stirrup worn over the sock, the stirrup being simulated by being circular knit as an integral piece and having an upper tubular leg encircling portion merging into a pair of lower substantially flat strap portions joined at lower ends thereof for placement under the arch of the foot of the wearer, each said lower strap portion having respective front and rear inwardly curved edges extending downwardly from a lower end of said upper leg portion, said sock comprising:

(a) stretchable leg and foot portions formed throughout of circular weft-knitted courses of skeleton yarns of a common color providing a knit base and body yarns of varying selected color interknit with said base; and (b) a simulated stirrup portion forming part of and interknit with portions of said leg and foot portions and formed of said body yarns on an outer surface portion of the sock at least in part with body yarns having at least one color contrasting with the body yarn or yarns forming other outer surface portions of said sock and knit so as to define the shape of said stimulated stirrup portion, said simulated stirrup portion including a tubular portion simulating the tubular leg encircling portion of the stirrup and stripe portions located below and forming extensions of said simulating tubular portion on opposite sides of said sock, said stripe portions comprising a pair of vertical stripes simulating said stirrup straps and extending down the length of said sock to said foot portion and to a level above the arch of said foot portion such that a lower end of each said stirrup strap simulating stripe can be hidden below the top of an athletic shoe worn by the wearer of the sock, the location at which the upper portion of said simulating stripes is joined to the lower portion of said simulating tubular portion being defined at the front and rear of the sock as viewed from one side of the sock when the sock is worn by pairs of what appear to be front and rear angularly related substantially straight border lines simulating when viewed from a distance said front and rear inwardly curved edges of said stirrup, said front border line being positioned on said tubular portion at a level lower than the level at which said rear border line is positioned on said tubular portion.

2. A knit athletic sock as claimed in claim 1 wherein said stirrup strap simulating stripes are edged with outer surface body yarns of a color contrasting both with the outer surface body yarns of said stripes and the color of the remainder of said sock not included in said simulated stirrup portion.

3. A knit athletic sock as claimed in claim 1 wherein each of said respective inwardly curved rear edges commences at a higher level than each of said respective front edges and said pairs of angularly related substantially straight border lines simulate in appearance said difference in level.

4. A knit athletic sock as claimed in claim 1 wherein said body yarns on said outer surface portion include body yarns on front and rear edges of said stripes of a color contrasting with the color of body yarns employed in other surface portions of the sock in a manner operative to define the shape of said stripes on the sock.

5. A knit athletic sock as claimed in claim 1 wherein the leg portion of said sock which includes said simulated stirrup portion is knit primarily of texturized nylon body yarn of selected color.

6. A knit athletic sock as claimed in claim 1 wherein said stretchable leg and foot portions include an integral garter band portion and said simulated stirrup portion includes said integral garter band portion.

7. A knit athletic sock as claimed in claim 1 wherein the leg portion of said sock which includes said simulated stirrup portion is knit primarily of synthetic thermoplastic texturized yarns.

* * * * *